US005778862A

United States Patent [19]

Fukui

[11] Patent Number: 5,778,862

[45] Date of Patent: Jul. 14, 1998

[54] IGNITION CONTROLLER FOR INTERNAL COMBUSTION ENGINE

[75] Inventor: Wataru Fukui, Tokyo, Japan

[73] Assignee: Mitsubishi Denki Kabushiki Kaisha, Tokyo, Japan

[21] Appl. No.: 890,393

[22] Filed: Jul. 9, 1997

[30] Foreign Application Priority Data

Feb. 3, 1997 [JP] Japan ..... 9-020418

[51] Int. Cl.[6] ..... F02P 11/00

[52] U.S. Cl. ..... 123/631; 123/603

[58] Field of Search ..... 123/631, 603, 123/651, 476

[56] References Cited

U.S. PATENT DOCUMENTS

| | | | |
|---|---|---|---|
| 4,909,229 | 3/1990 | Hashizume | 123/631 |
| 4,972,822 | 11/1990 | Hashizume | 123/631 |
| 5,020,506 | 6/1991 | Ozawa | 123/631 |
| 5,622,153 | 4/1997 | Ott et al. | 123/476 |

FOREIGN PATENT DOCUMENTS

| | | | |
|---|---|---|---|
| 58-220963 | 12/1983 | Japan | 123/631 |

*Primary Examiner*—Raymond A. Nelli

*Attorney, Agent, or Firm*—Sughrue, Mion, Zinn, Macpeak & Seas, PLLC

[57] ABSTRACT

In an ignition controller for an internal combustion engine, an angle sensor includes a plurality of sensor means for individually outputting a pulse signal SGT1 corresponding to a first reference crank angle and a pulse signal SGT2 corresponding to a second reference crank angle and a control/arithmetic operation circuit includes a timing calculation means for calculating the timings at which ignition coils are controlled according to an operating state, count means for counting the number of the pulses of one of respective pulse signals which are detected between two continuous pulses of the other of them, reverse rotation discriminating means for discriminating the reverse rotation of the internal combustion engine based on the count values CA1 and CA2 of the respective pulse signals and control prohibition means for prohibiting the output of drive signals P1 and P2 in response to a reverse rotation discriminating signal to thereby prohibit ignition control in the occurrence of the reverse rotation by discriminating the reverse rotation from the pulse counting state of respective reference crank angles having a different phase each other. With this arrangement, there is provided the ignition controller for the internal combustion engine capable of avoiding erroneous control caused by the reverse rotation.

5 Claims, 12 Drawing Sheets

IGNITION CONTROLLER FOR INTERNAL COMBUSTION ENGINE

BACKGROUND OF THE INVENTION

1. Field of the Invention

The present invention relates to an ignition controller for an internal combustion engine for controlling the ignition of respective cylinders by supplying a low voltage, and more specifically, to an ignition controller for an internal combustion engine capable of securing an excellently controlled state by preventing ignition caused by a voltage erroneously supplied by the erroneous detection of an angle signal by promptly discriminating the reverse rotation of the internal combustion engine.

2. Description of the Related Art

FIG. 10 is a view showing the arrangement of an ignition controller for a conventional internal combustion engine described in, for example, Japanese Patent Publication No. 62-36153 and the like. FIG. 11 is a timing chart showing the output waveform of an angle sensor in FIG. 10, and FIG. 12 and FIG. 13 are timing charts showing erroneous control operation executed by the conventional controller shown in FIG. 10 when reverse rotation occurs.

In FIG. 10, an angle sensor 10 disposed to the crank shaft or the cam shaft (not shown) of the internal shaft or the cam shaft (not shown) of the internal combustion engine detects the rotational angle of the internal combustion engine and outputs a crank angle signal SGT showing the reference crank angle of each of cylinders and a cylinder identification signal SGC for identifying each of the cylinders.

Usually, the angle sensor 10 includes a crank angle sensor and a cylinder identification sensor (now shown). The crank angle sensor of the sensors for creating the crank angle signal SGT is disposed to the crank shaft and the cylinder identification sensor of them for creating the cylinder identification signal SGC is disposed to the cam shaft whose rotations are reduced to one half those of the crank shaft.

Various sensors 12 including an amount of intake air sensor, a water temperature sensor, a start switch and the like detect the operating state D of the internal combustion engine and create various detection signals showing the operating state D.

Injectors 16 disposed in correspondence to the respective cylinders of the internal combustion engine inject a predetermined amount of fuel by driving the fuel injection valves of the respective cylinders at predetermined timings.

Ignition coils 18*a* and 18*b* disposed in correspondence to each of the cylinders of the internal combustion engine are composed of a transformer including a primary winding and a secondary winding and a high ignition voltage is imposed on the ignition plug 20 of each cylinder from the secondary winding.

The case shown above is arranged such that a pair of the ignition coils 18*a* and 18*b* are provided and the ignition plugs 20 of the #1 and #4 cylinders are connected to the respective one ends of one of the ignition coils or the ignition coil 18*a* and the ignition plugs 20 of the #3 and #2 cylinders are connected to the respective one ends of the other of the ignition coils or the ignition coil 18*b*. Therefore, the respective one pairs of the cylinders, that is, the #1 and #4 cylinders and the #3 and #2 cylinders are simultaneously ignited, respectively.

Power transistors connected in series to the primary windings of the respective ignition coils 18*a* and 18*b* shut off primary currents i1*a* and i1*b* flowing to the respective primary windings and generate an increased high voltage from the secondary windings of the respective ignition coils 18*a* and 18*b*.

An ECU (electronic control unit) 30 composed of a microcomputer includes an input interface 32, a control/arithmetic operation circuit 34 and an output interface 36. The input interface 32 fetches the crank angle signal SGT, the cylinder identification signal SGC and the operating state D and inputs them to the control/arithmetic operation circuit 34.

The control/arithmetic operation circuit 34 calculates the respective control timings of the injectors 16 and the ignition coils 18*a* and 18*b* based on the various types of information SGT, SGC and D through the input interface 32 and creates drive signals J1–J4 to the respective injectors 16 and drive signals P1 and P2 to the ignition coils 18*a* and 18*b* according to the respective control timings.

The output interface 36 outputs the drive signals J1–J4 and drives the injectors 16 of the respective cylinders as well as outputs the drive signals P1 and P2 to thereby drive the power transistors 22*a* and 22*b*.

That is, the drive signal P1 to the ignition coil 18*a* (base current of the power transistor 22*a*) intermittently turns on the power transistor 22*a* to thereby shut off the primary current i1*a* supplied to the ignition coil 18*a* and the drive signal P2 to the ignition coil 18*b* (base current of the power transistor 22*b*) intermittently turns on the power transistor 22*b* to thereby shut off the primary current i1*b* supplied to the ignition coil 18*b*.

In FIG. 11, the crank angle signal SGT is composed of a pulse signal according to the rotation of the crank shaft and the rising edges of respective pulses show a first reference crank angle B75° (75° this side from TDC) corresponding to the respective cylinders (#1–#4) and the falling edges thereof show a second reference crank angle B5° (5° this side from TDC).

The cylinder identification signal SGC has pulses offset from the pulses of the crank angle signal SGT corresponding to the #1 and #4 cylinders and generates a level (H, L) at the respective edges (first and second reference crank angles) of the crank angle signal SGT in a predetermined sequence to thereby specify the respective cylinders (#1–#4 cylinders).

Therefore, the #1 and #4 cylinders can be identified by the level "1" of the cylinder identification signal SGC at the rising edges of the crank angle signal SGT (first reference crank angle) B75° and a specific cylinder, that is, the #1 cylinder can be identified by the level "1" of the cylinder identification signal SGC at the falling edge of the crank angle signal SGT (second reference crank angle) B5°.

Next, operation of the ignition controller for the conventional internal combustion engine shown in FIG. 10 will be described with reference to FIG. 11.

Since the level of the cylinder identification signal SGC at the first reference crank angle B75° (see FIG. 11) alternately changes to the H and L levels in ordinary operation, the control/arithmetic operation circuit 34 can identify a group of the cylinders which is simultaneously ignited (group sparking).

Further, since the level of the cylinder identification signal SGC at the second reference crank angle B5° is set to the H level only to the specific cylinder (#1 cylinder), the control/arithmetic operation circuit 34 can identify the specific cylinder.

Note, when the cylinder identification signal SGC has a pattern set as shown in FIG. 11, the respective cylinders can be also specified from the levels of the cylinder identification signal SGC at the pair of edges B5° and B75° of the respective pulses of the crank angle signal SGT.

That is, when the levels of the cylinder identification signal SGC at the respective reference crank angles B5° and B75° are "0, 1", "the #1, #4 cylinders" are specified (however, when the level at the next edge B5° is "1", the #1 cylinder is specified), when the levels are "1, 0", "the #3 cylinder" is specified, and when the levels are "0, 0", "the #2 cylinder" is specified as a corresponding cylinder or cylinders, respectively.

When the respective cylinders are identified, the control/calculation circuit 34 detects the operating state control/calculation circuit 34 detects the operating state of the internal combustion engine based on the crank angle signal SGT and the cylinder identification signal SGC from the angle sensor 10, the operating state detection signal D from the various sensors 12 as well as calculates the control parameters (timing at which fuel is injected, ignition timing and the like) of each cylinder using the respective reference crank angles B75° and B5° as control references.

Therefore, the drive signals J1–J4 to the injectors 16 are sequentially created in correspondence to the respective cylinders at optimum control timings according to the operating state of the internal combustion engine and the drive signal P1 to the power transistor **22*a* (ignition coil 18*a*) and the drive signal P2 to the power transistor 22*b* (ignition coil 18*b***) are alternately created to the respective groups of the cylinders.

The power transistors **22*a* and 22*b*** are alternately turned on by the drive signals P1 and P2 to thereby shut off the primary currents i1*a* and i1*b* supplied to the respective ignition coils **18*a* and 18*b*, so that the ignition plugs 20** of the respective cylinders are sequentially discharged for ignition control.

Usually, the timings at which the primary currents i1*a* and i1*b* are shut off (ignition timings) are set to the vicinity of the second reference crank angle B5°, that is, to the vicinity of a compression upper dead point.

Further, the control/arithmetic operation circuit 34 does not execute the timer control using the respective reference crank angles B75° and B5° as start points when the internal combustion engine starts operation or when the internal combustion engine operates at a low rotational speed in which the crank angle signal SGT makes a large amount of cyclic variation but executes bypass control in which the supply of the primary currents i1*a* and i1*b* is started at the first reference crank angle B75° and the supply is shut off at the second reference crank angle B5°.

The control/arithmetic operation circuit 34 controls the injectors 16 and the ignition coils **18*a* and 18*b*** of the respective cylinders at optimum timings according to the operating state.

However, if a start switch is turned off during a compression stroke (at a crank angle position this side of an upper dead point) by the operation mistake of an operator at the start of the engine before the internal combustion engine completely finishes its starting operation, the internal combustion engine stops by being reversed.

In this case, since the control/arithmetic operation circuit 34 cannot recognizes the reverse rotation, it erroneously shuts off the primary current i1 (i1*a* or i1*b*). Thus, there is a possibility that the internal combustion engine is damaged.

For example, when the internal combustion engine is reversed at a time t2 just after it passes through the first reference crank angle B75° of the #1 cylinder in normal rotation (during a compression stroke) as shown in FIG. 12, the control/arithmetic operation circuit 34 starts to supply of the primary current i1*a* to the #1 cylinder at the first reference crank angle B75° (time t1) in the normal rotation and then misidentifies the first reference crank angle B75° (time t3) after the reverse rotation (time t2) as the second reference crank angle B5° and ignites the ignition plug at an excessively advanced angle by shutting off the primary current i1*a*.

Further, the internal combustion engine is reversed at a time t4 just after it passes through the second reference crank angle B5° of the #4 cylinder in normal rotation (during a compression stroke) as shown in FIG. 13, the control/arithmetic operation circuit 34 starts to supply the primary current i1*b* to the #2 cylinder by misidentifying the second reference crank angle B5° (time t5) after reverse rotation (time t4) as the first reference crank angle B75° of the #2 cylinder.

Since the ignition controller of the conventional internal combustion engine takes no countermeasure for preventing the misidentification of a reference crank angle when reverse rotation is caused by the turning-off of a start switch and the like as described above, there is a problem that an unstable combustion state is caused by the ignition executed at an excessively advanced angle (see FIG. 12), erroneous supply of power (see FIG. 13) and the like, by which an internal combustion engine is adversely affected.

An object of the present invention made to solve the above problem is to provide an ignition controller for an internal combustion engine capable of preventing an erroneously controlled state by detecting first and second reference crank angles having a different phase each other, discriminating reverse rotation from pulses counted corresponding to the respective reference crank angles and prohibiting ignition when reverse rotation occurs.

SUMMARY OF THE INVENTION

An ignition controller for an internal combustion engine according to the present invention comprises an angle sensor for detecting the rotational angle of the internal combustion engine; various sensors for detecting the operating state of the internal combustion engine; ignition coils for imposing a high voltage to the ignition plugs of the respective cylinders of the internal combustion engine; and a control/arithmetic operation circuit for creating drive signals to at least the ignition coils based on the rotation angle and the operating state, wherein the angle sensor includes a plurality of sensor means for individually outputting a first pulse signal corresponding to the first reference crank angle of the respective cylinders and a second pulse signal corresponding to the second reference crank angle of the respective cylinders, and the control/arithmetic operation circuit includes timing calculation means for calculating the timings at which at least the ignition coils are controlled according to the operating state; count means for counting the number of the pulses of one of the first and second pulse signals which are detected between two continuous pulses of the other of them; reverse rotation discriminating means for discriminating the reverse rotation of the internal combustion engine based on at least one of the count values of the first and second pulse signals; and control prohibition means for prohibiting the output of the drive signal in response to a reverse rotation discriminating signal.

The angle sensor of the ignition controller for the internal combustion engine of the present invention creates a first crank angle signal as the first pulse signal; and a second crank angle signal as the second pulse signal, and the reverse rotation discriminating means creates the discrimination signal when the pulses of at least one of the first and second pulse signals are continuously counted.

Further, the angle sensor of the ignition controller for the internal combustion engine of the present invention creates a crank angle signal as the first pulse signal; and a cylinder discrimination signal as the second pulse signal, wherein the second pulse signal includes respective one pulses showing the second reference crank angle and an even number of pulses created continuously to at least one of the respective one pulses to discriminate the respective cylinders and when the first pulse signals are continuously counted or when the counted value of the second pulse signal shows an even value, the reverse rotation discriminating means creates the discrimination signal.

The various sensor of the ignition controller for the internal combustion engine of the present invention include a start switch of the internal combustion engine and the reverse rotation discriminating means sets up a reverse rotation flag when the reverse rotation is discriminated as well as clears the reverse rotation flag in response to the operation signal from the start switch.

The first reference crank angle of the ignition controller for the internal combustion engine of the present invention corresponds to the timing at which an initial current starts to be supplied to the ignition coils of the respective cylinders and the second reference crank angle thereof corresponds to the timing at which initial ignition is executed to the ignition coils of the respective cylinders, and when the internal combustion engine is operated at a low rotational speed and the reverse flag is cleared, the control/arithmetic operation circuit starts to supply a current to the respective ignition coils at the second reference crank angle in response to the operation signal from the start switch and shuts off the current in the vicinity of a compression upper dead point after the rotation of a predetermined crank angle.

DESCRIPTION OF THE PREFERRED EMBODIMENT

Embodiment 1

Figure 1:
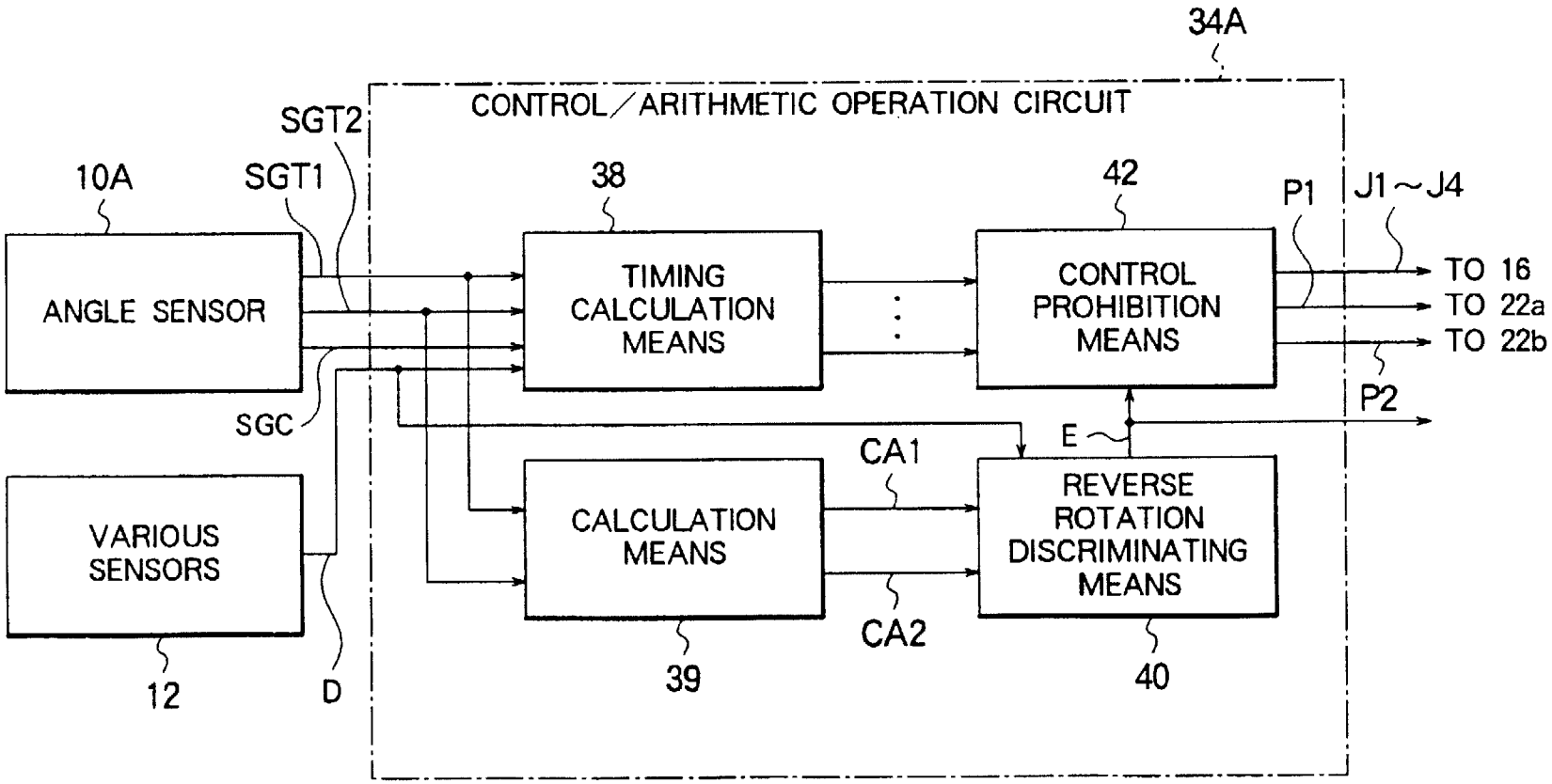
FIG. 1 is a block diagram showing the main portion of an embodiment 1 of the present invention.

An embodiment 1 of the present invention will be described with reference to the drawings. FIG. 1 is a block diagram showing the main portion of the embodiment 1 of the present invention, wherein various sensors 12, injectors 16, power transistors **22*a*, 22*b*** are the same as those mentioned above.

Figure 10:
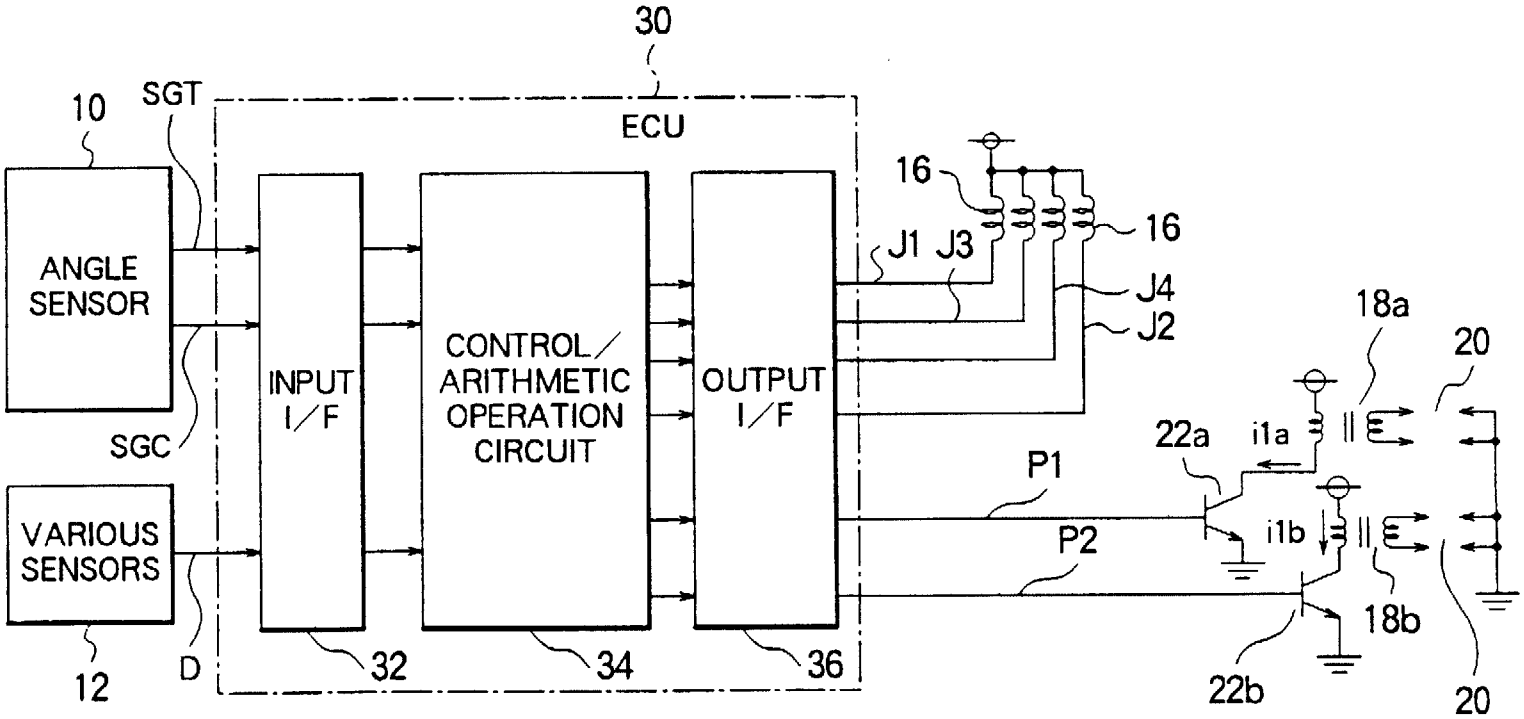
FIG. 10 is a view showing the arrangement of an ignition controller for a conventional internal combustion engine.
Figure 11:
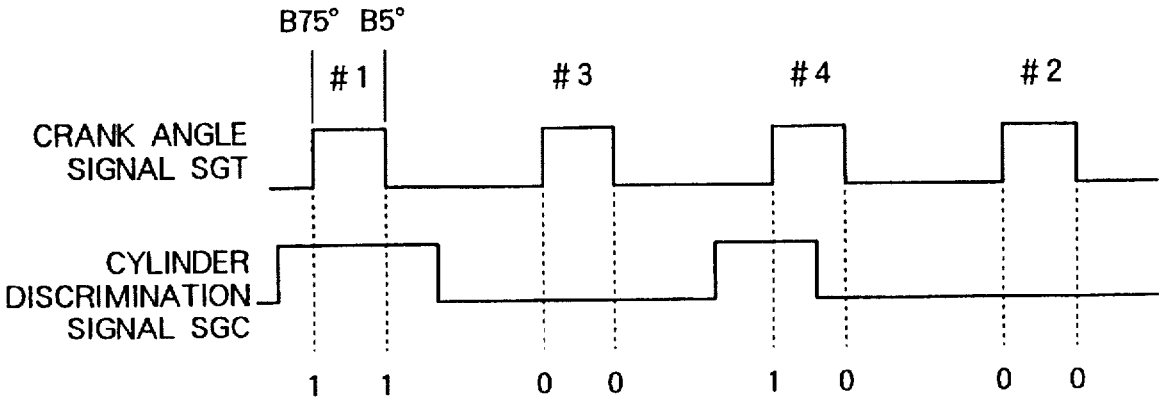
FIG. 11 is a timing chart showing a signal output from an angle sensor in the ignition controller of the conventional internal combustion engine.
Figure 12:
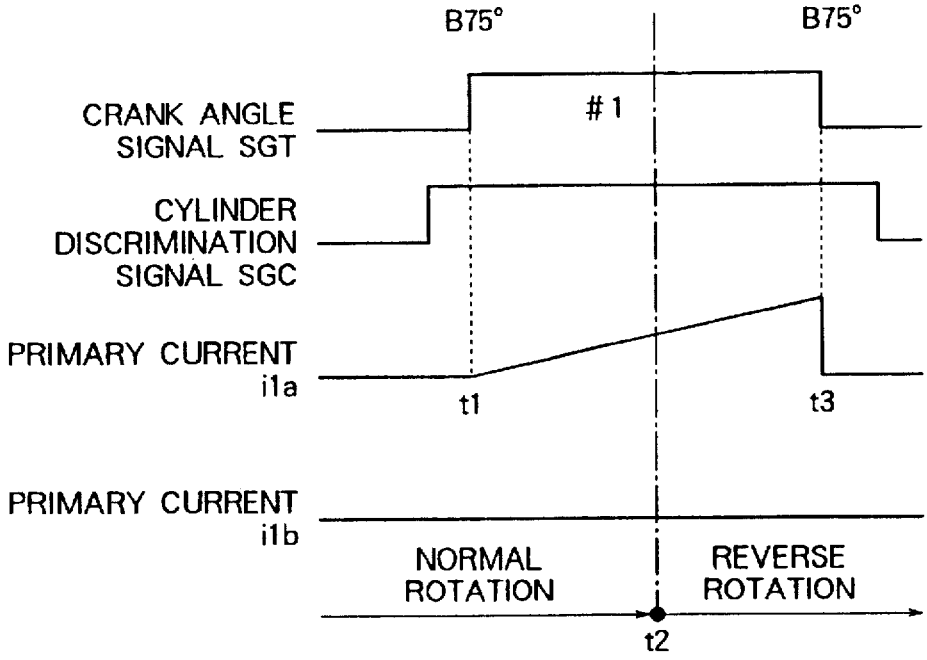
FIG. 12 is a timing chart explaining primary current supply operation when reverse rotation occurs in the ignition controller for the conventional internal combustion engine.
Figure 13:
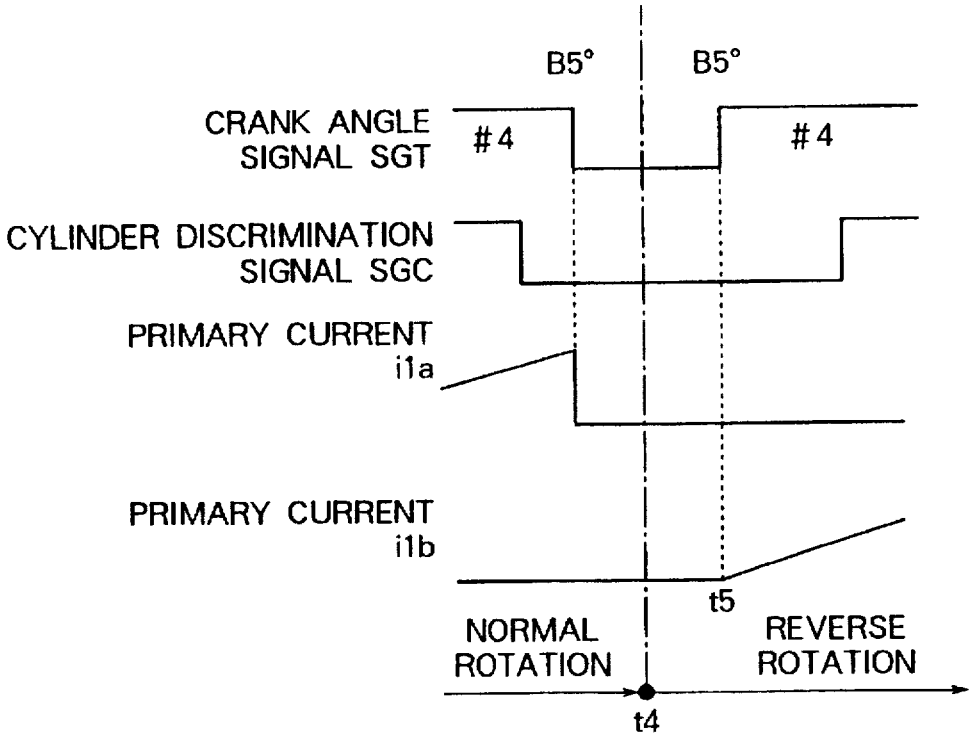
FIG. 13 is a timing chart explaining primary current supply operation when reverse rotation occurs in the ignition controller for the conventional internal combustion engine.

The components (an ECU 30, an input interface 32, an output interface 36 and the like) which are omitted and not shown in FIG. 1 are arranged similarly to those shown in FIG. 10.

Therefore, although an ignition controller applied to group sparking is described here as an example, it is needless to say that the ignition controller is also applicable to any device having an individual power transistor and ignition coil provided with each of cylinders so long as the device is of a lower power distribution type.

In this case, an angle sensor 10A includes a plurality of sensor means (crank angle sensors) for individually outputting a pulse signal corresponding to the first reference crank angle B75° of each of cylinders, that is, a first crank angle signal SGT1 and a pulse signal corresponding to the second reference crank angle B5° of each of the cylinders, that is, a second crank angle signal SGT2 together with a cylinder identification sensor similar to that described above.

Each of the crank angle sensors in the angle sensor 10A is composed of, for example, electromagnetic pickups disposed in correspondence to the respective reference crank angles of a crank shaft and a wave shaping circuit for converting the signals output from the electromagnetic pickups to pulses.

A control/arithmetic operation circuit 34A includes timing calculation means 38 for calculating a control parameter according to an operating state D, count means 39 for calculating the pulse numbers of the respective crank angle signals SGT1 and SGT2, a reverse rotation discriminating means 40 for discriminating reserve rotation based on at least one of the calculated values CA1 and CA2 of the respective pulse numbers and control prohibition means 42 for prohibiting ignition control and fuel injection control in response to a reverse rotation discriminating signal E.

The timing calculation means 38 in the control/arithmetic operation circuit 34A calculates respective control timings to the injectors 16 and the ignition coils **18*a* and 18*b* (see FIG. 10) according to the respective crank angle signals SGT1 and SGT2, a cylinder identification signal SGC and the operating state D and creates injector drive signals J1–J4 and ignition drive signals P1 and P2** according to the respective control timings.

The count means 39 includes a plurality of counters for individually counting the pulse numbers of the respective crank angle signals SGT1 and SGT2, counts the number of the pulses of one of the respective crank angle signals SGT1 and SGT2 which are detected between two continuous pulses of the other of them and outputs respective count values CA1 and CA2.

The reverse rotation discriminating means 40 discriminates the reverse rotation based on the count values CA1 and CA2 when at least one of the respective crank angle signals SGT1 and SGT2 is continuously counted and creates the discrimination signal E.

Further, the reverse rotation discriminating means 40 discriminated (to be described below) as well as clears the reverse flag F in response to the operation signal (included in the operating state D) of a start switch.

Next, reverse rotation discriminating operation executed by the embodiment 1 of the present invention shown in FIG. 1 will be described with reference to the flowchart of FIG. 3 together with the timing chart of FIG. 2.

Figure 2:
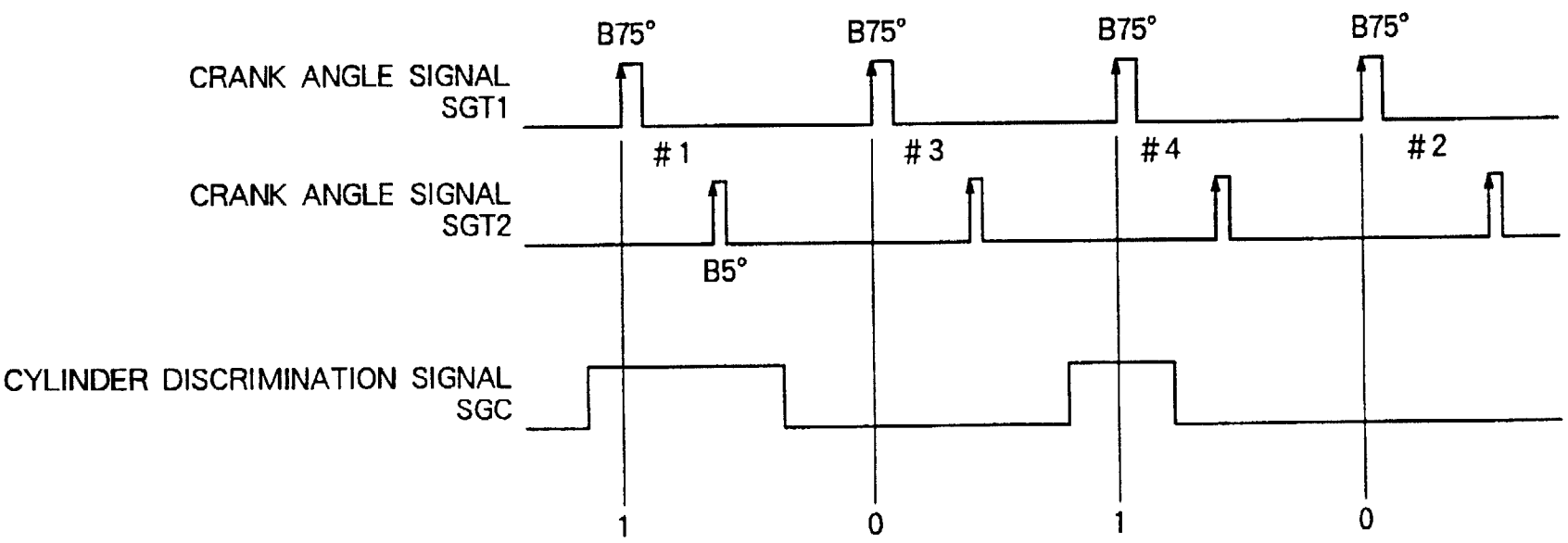
FIG. 2 is a timing chart explaining operation of the embodiment 1 of the present invention.

FIG. 2 shows the waveforms of respective signals output from the angle sensor 10A and they are the same as those described above except that the respective crank angle signals SGT1 and SGT2 have individual waveforms.

In FIG. 2, the rising edges of the respective pulses of the first crank angle signal SGT1 and the second crank angle signal SGT2 are allocated to the first reference crank angle B75° and the second reference crank angle B5° of each of the cylinders, respectively.

Therefore, the pulses of the respective crank angle signals SGT1 and SGT2 are alternately detected at all times in normal rotation and ones of them are continuously detected when reverse rotation occurs.

Note, since the pulse pattern of the cylinder identification signal SGC and a cylinder identification processing are the same as those mentioned above, the description thereof is omitted here.

First, it is assumed that the count values CA1 and CA2 in the count means 39 are cleared to "0" by the operation of the start switch at the start of the internal combustion engine and the reverse flag F in the reverse rotation discriminating means 40 is cleared to "0".

Figure 3:
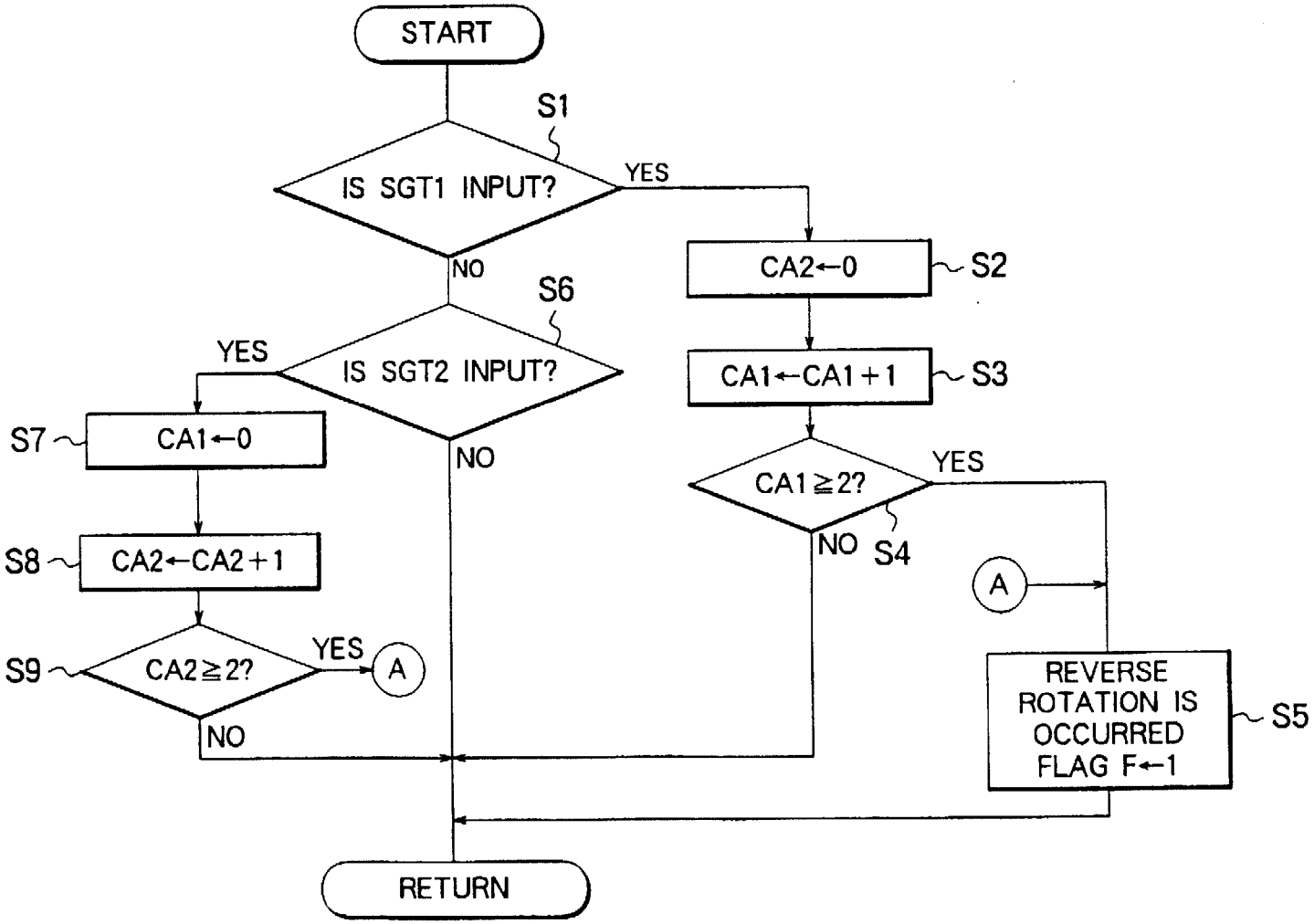
FIG. 3 is a flowchart showing reverse rotation discriminating operation executed by the embodiment 1 of the present invention.

In FIG. 3, the count means 39 determines whether the first crank angle signal SGT1 is input or not (step S1) and if it is determined that the signal SGT1 is input (that is, YES), the count value CA2 of the second crank angle signal SGT2 is cleared to 0 (step S2) and the count value CA1 of the first crank angle signal SGT1 is incremented (step S3).

Subsequently, the reverse rotation discriminating means 40 determines whether the count value CA1 is two or more (whether the first crank angle signals SGT1 are continuously detected) or not (step S4) and if it is determined that CA1<2 (that is, NO), the reverse rotation discriminating means 40 regards the operating state as the normal rotation state and the process returns as it is.

Therefore, since the discrimination signal E is not created, the control prohibition means 42 is not operated and the internal combustion engine is controlled ordinarily by the drive signals J1–J4, P1 and P2 from the control/arithmetic operation circuit 34A.

On the other hand, if it is determined at step S4 that CA1≧2 (that is, YES), the reverse rotation discriminating means 40 discriminates that the reverse rotation occurs and sets "1" to the reverse flag F as well as outputs the discrimination signal E showing the reverse rotation (step S5) and the process returns.

Therefore, the control prohibition means 42 prohibits the output of the fuel injection drive signals J1–J4 and the ignition drive signals P1 and P2, so that the internal combustion engine is not erroneously controlled by the control/arithmetic operation circuit 34A.

When it is determined that the first crank angle signal SGT1 is not input (that is, NO) at step S1, the count means 39 determines whether the second crank angle signal SGT2 is input or not (step S6). If the second crank angle signal SGT2 is input, the calculation means 39 clears the count value CA1 of the first crank angle signal SGT1 to 0 (step S7) and increments the count value CA2 of the second crank angle signal SGT2 (step S8).

Subsequently, the reverse rotation discriminating means 40 determines whether the count value CA2 is 2 or more (whether the second crank angle signals SGT2 are continuously detected) or not (step S9) and if it is determined that CA2<2 (that is NO), the reverse rotation discriminating means 40 regards the operating state as the normal rotation state and the process returns as it is. In this case, the internal combustion engine is controlled ordinarily.

On the other hand, if it is determined that CA2≧2 (that is, YES), the reverse rotation discriminating means 40 determines that the reverse rotation occurs and the process goes to step S5 which is executed when reverse rotation occurs.

Figure 4:
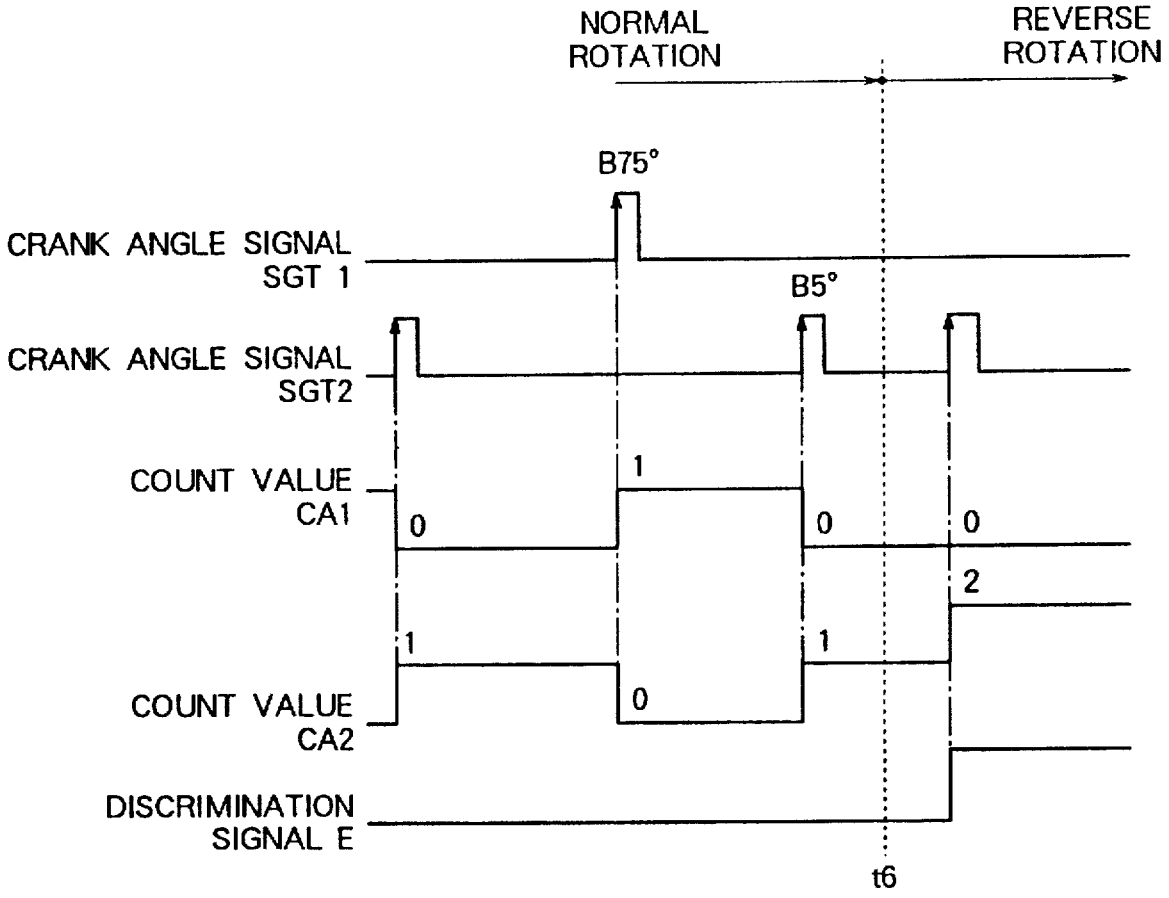
FIG. 4 is a timing chart explaining the reverse rotation discriminating operation executed by the embodiment 1 of the present invention.

In this case, since the respective drive signals J1–J4 and P1, P2 are not output, the internal combustion engine is prevented from being damaged by erroneous control and the like FIG. 4 is a timing chart explaining the above reverse rotation discriminating operation for preventing erroneous control and shows a case that the reverse rotation occurs at a time t6.

In this case, since the internal combustion engine is reversed just after one of second crank angle signals SGT2 (B5°) is detected, the second crank angle signals SGT2 (B5°) are continuously detected.

Therefore, it can be found that the control is prohibited by that the count value CA2 is incremented to "2" at step S8 and the discrimination signal E is created at step S5.

Note, the discrimination signal E may be used to show the occurrence of the reverse rotation and the like by being output to an external unit when necessary.

The various sensors 12 include the start switch of the internal combustion engine and the control prohibition state is released by the reverse flag F which is cleared when the start switch is operated next time.

As described above, the revere operation can be promptly discriminated in such a manner that the crank angle signals SGT1 and SGT2 composed of the pulses showing the respective reference crank angles B75° and B5° are obtained from the individual sensor means and the input phases of the respective pulses are detected from the count values CA1 and CA2 of the respective pulses.

The control/arithmetic operation circuit 34A can be simply arranged because it is sufficient that the count means 39 has a small counting capacity as well as it suffices for the reverse rotation discriminating means 40 to execute a simple determination processing whether the count values CA1 and CA2 are "1" or "2" in this case.

Further, when any one of the count values CA1 and CA2 is used for the determination of the reverse rotation, the arrangement of the control/arithmetic operation circuit 34A can be more simplified.

Embodiment 2

Note, although the cylinder identification signal SGC is created independently of the respective crank angle signals SGT1 and SGT2 in the embodiment 1, the cylinder identification signal SGC may be created so that it is composed of a pulse train and contained in the series of one of the crank angle signals, for example, the second crank angle signal SGT2.

Figure 5:
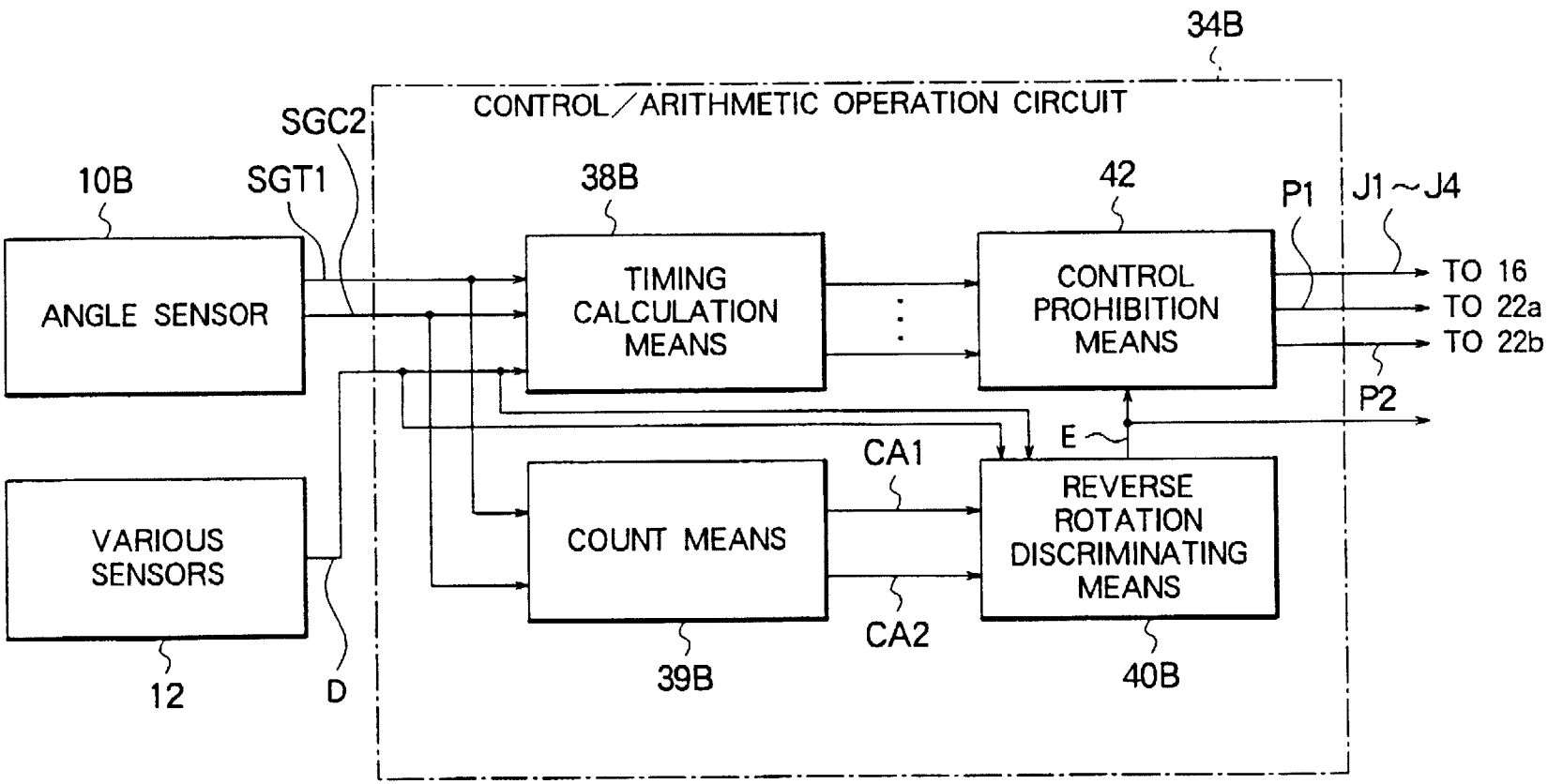
FIG. 5 is a block diagram showing the main portion of an embodiment 2 of the present invention.
Figure 6:
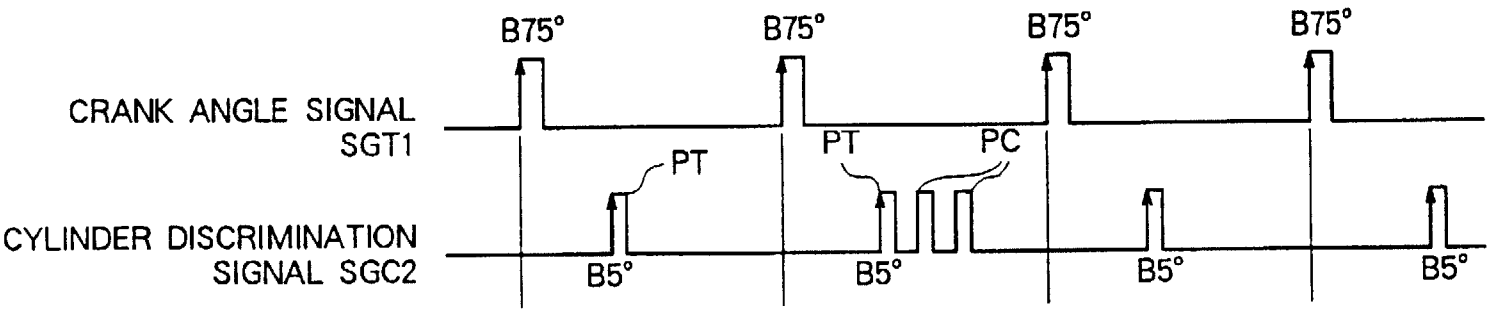
FIG. 6 is a timing chart showing a signal output from an angle sensor in the embodiment 2 of the present invention.

FIG. 5 is a block diagram showing the main portion of a second embodiment 2 of the present invention in which the signals output from an angle sensor is arranged as two series of signals and FIG. 6 is a timing chart showing the signals output from an angle sensor. In the drawings, the same numerals are used to denote the components similar to those mentioned above and the description thereof is omitted.

In this case, the angle sensor 10B creates a crank angle signal SGT1 as a first pulse signal and a cylinder identification signal SGC2 as a second pulse signal.

As shown in FIG. 6, the cylinder identification signal SGC2 includes respective one pulses PT each showing a second reference crank angle B5° and an even number (two in this case) of pulses PC which are created continuous to at least one of the respective one pulses PT which identify respective cylinders.

With this arrangement, when an internal combustion engine is in normal rotation, an odd number of pulses of the cylinder identification signal SGC2 always exist in the respective pulse regions of the crank angle signal SGT1.

A timing calculation means 38B in a control/arithmetic operation circuit 34B determines control parameters from the two series of the pulse signals SGT1 and SGT 2 and an operating state D.

A reverse rotation discriminating means 40B creates the discrimination signal E when a count value CA1 shows a value of two or more (when the crank angle signals SGT1 are continuously counted) or the count value CA2 of the cylinder identification signal SGC2 shows an even number.

Next, reverse rotation discriminating operation executed by the embodiment 2 of the present invention shown in FIG. 5 will be described with reference to the flow chart of FIG. 7 together with the flowchart of FIG. 7.

Figure 7:
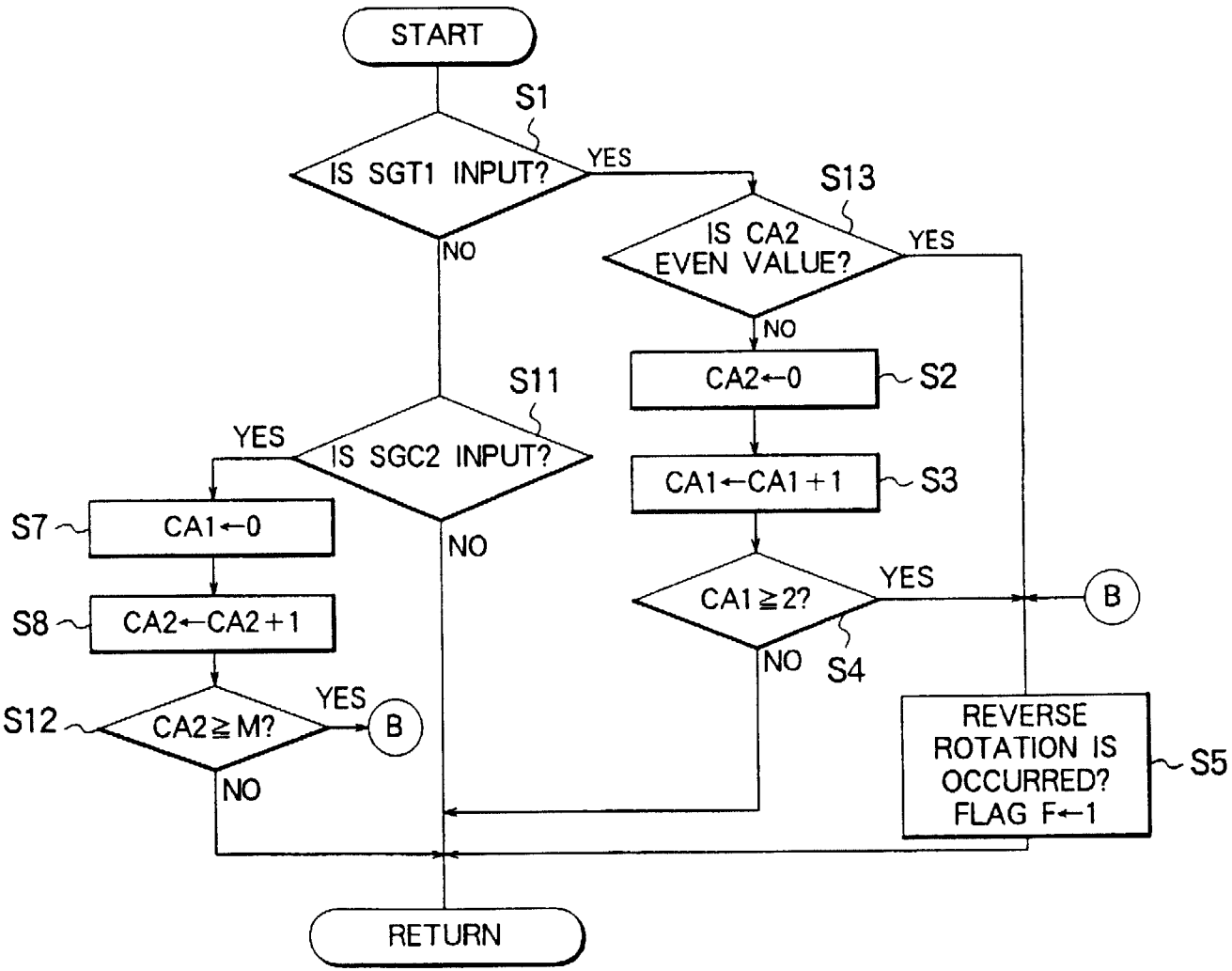
FIG. 7 is a flowchart showing the reverse rotation discriminating operation executed by the embodiment 2 of the present invention.

In FIG. 7, respective steps S1–S5, S7 and S8 are similar to those described above.

When it is determines that the crank angle signal SGT1 is not input (that is, NO) at step S1, a count means 39B subsequently determines whether the cylinder identification signal SGC2 is input or not (step S11).

If it is determined that the cylinder identification signal SGC2 is input (that is, YES), the count value CA1 is cleared (step S7) and the count value CA2 is incremented as mentioned above (step S8).

Next, the reverse rotation discriminating means 40B determines whether the count value CA2 reaches a predetermined value M or more or not (step S12) and when it is determined that CA2≧M (that is, YES), the process goes to step at once S5 which is to be taken in the occurrence of reverse rotation and promptly prohibits control. Further, when it is determined that CA2<M (that is, NO), the process returns as it is.

Note, since the predetermined value M acting as a comparison reference in step 12 is set to a value which is larger than the maximum pulse number of the cylinder identification signal SGC2 in the region corresponding to each cylinder, when the pulse number is 1 or 3 as shown in FIG. 6, the predetermined value M is set to 4.

Although not shown here, when the number of the pulses of the cylinder identification signal SGC2 is set to 1, 3 and 5 to permit a group of cylinders to be identified, the predetermined value M is set to 6.

On the other hand, when it is determined that the crank angle signal SGT1 is input (that is, YES), the reverse rotation discriminating means 40B determines whether the count value CA2 of the cylinder identification signal SGC2 is an even value or not (step S13).

If it is determined that the count value CA2 is not the even value (that is NO), the count value CA2 is cleared (step S2), the count value CA1 is incremented (step S3) and whether reverse rotation occurs or not is determined based on the count value CA1 (step S4) and if the reverse rotation occurs, the process executes step S5 and returns.

Further, when it is determined that the count value CA2 is the even value (that is, YES) at step S13, the reverse rotation discriminating means 40B recognizes that the reverse rotation occurs during the period of time from the detection of the pulse of the crank angle signal SGT1 last time to the detection thereof this time and executes step S5 to be executed in the occurrence of reverse rotation.

As described above, since the cylinder identification signal SGC2 is arranged by continuously forming even pulses in a portion of the second crank angle signal, when the count value CA1 shows a value of 2 or more or when the count value CA2 shows an even value, the reverse rotation of the internal combustion engine is promptly detected, so that the erroneous control thereof can be prevented.

Further, Since it suffices to compose the signal output from the angle sensor 10B of two series, the sensor can be simply arranged.

Embodiment 3

Note, although the embodiments 1 and 2 describe only the reverse rotation discriminating operation and the control prohibiting operation when reverse rotation occurs, when the reverse rotation occurs at a timing just after the first reference crank angle B75° is detected, the primary current (ignition drive signal) is already supplied at the time the reverse rotation is detected. Thus, there is a possibility that when the control is prohibited, the primary current is continuously supplied, whereas when the primary current is forcibly shut off, it is shut off at an improper timing.

Therefore, to securely prevent the improper shut-off of the primary current as described above, it is desirable that the start of supply of the primary current is prohibited at the first reference crank angle B75° even in normal rotation while the start switch is turned on.

An embodiment 3 of the present invention in which the start of supply of the primary current is prohibited at the first reference crank angle B75° at start will be described with reference to the drawings.

Note, the arrangement of a control/arithmetic operation circuit of the third embodiment 3 of the present invention is similar to that shown in, for example, FIG. 1 except that timing calculation means has a different function.

Figure 8:
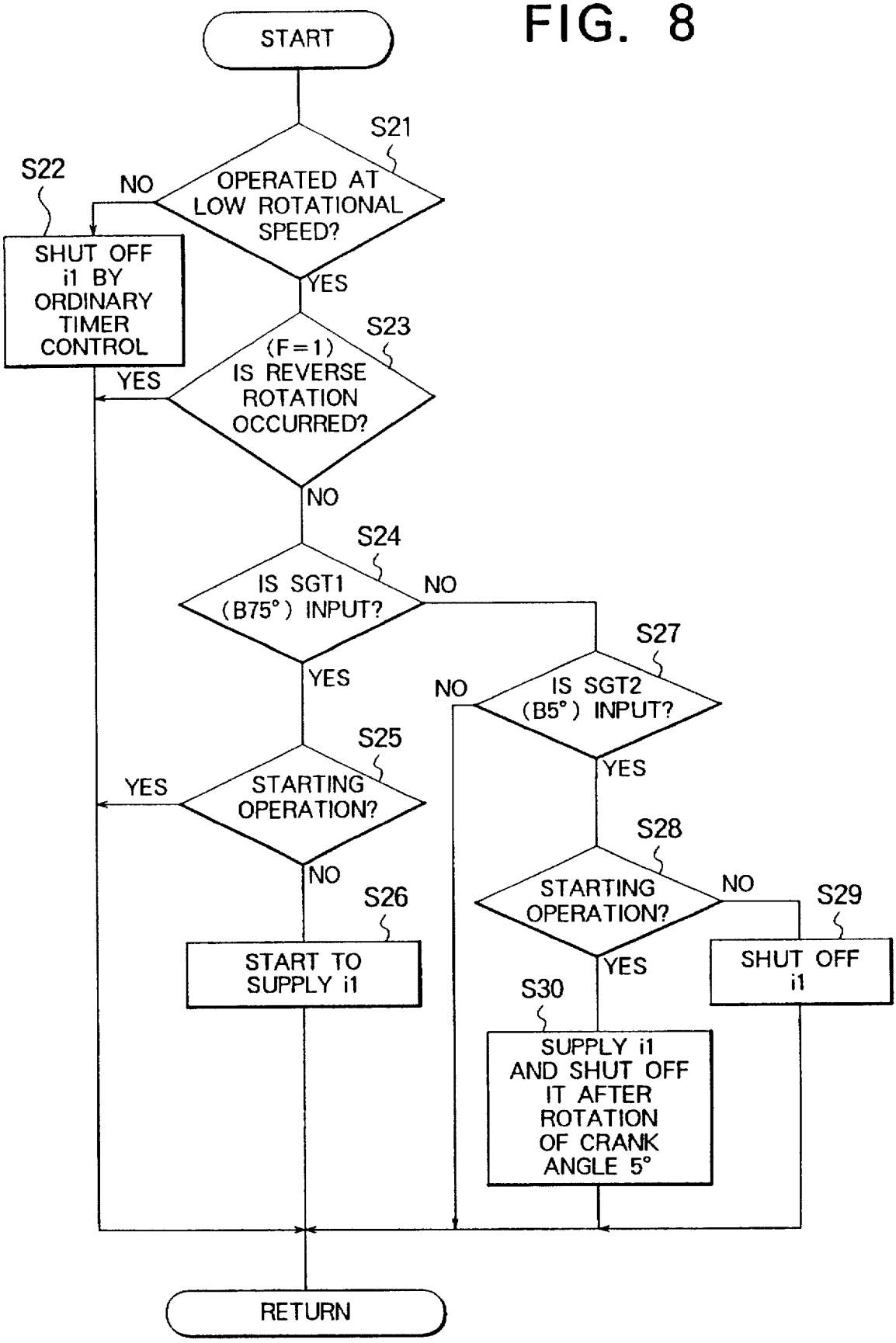
FIG. 8 is a flowchart showing primary current supply operation executed by an embodiment 3 of the present invention.
Figure 9:
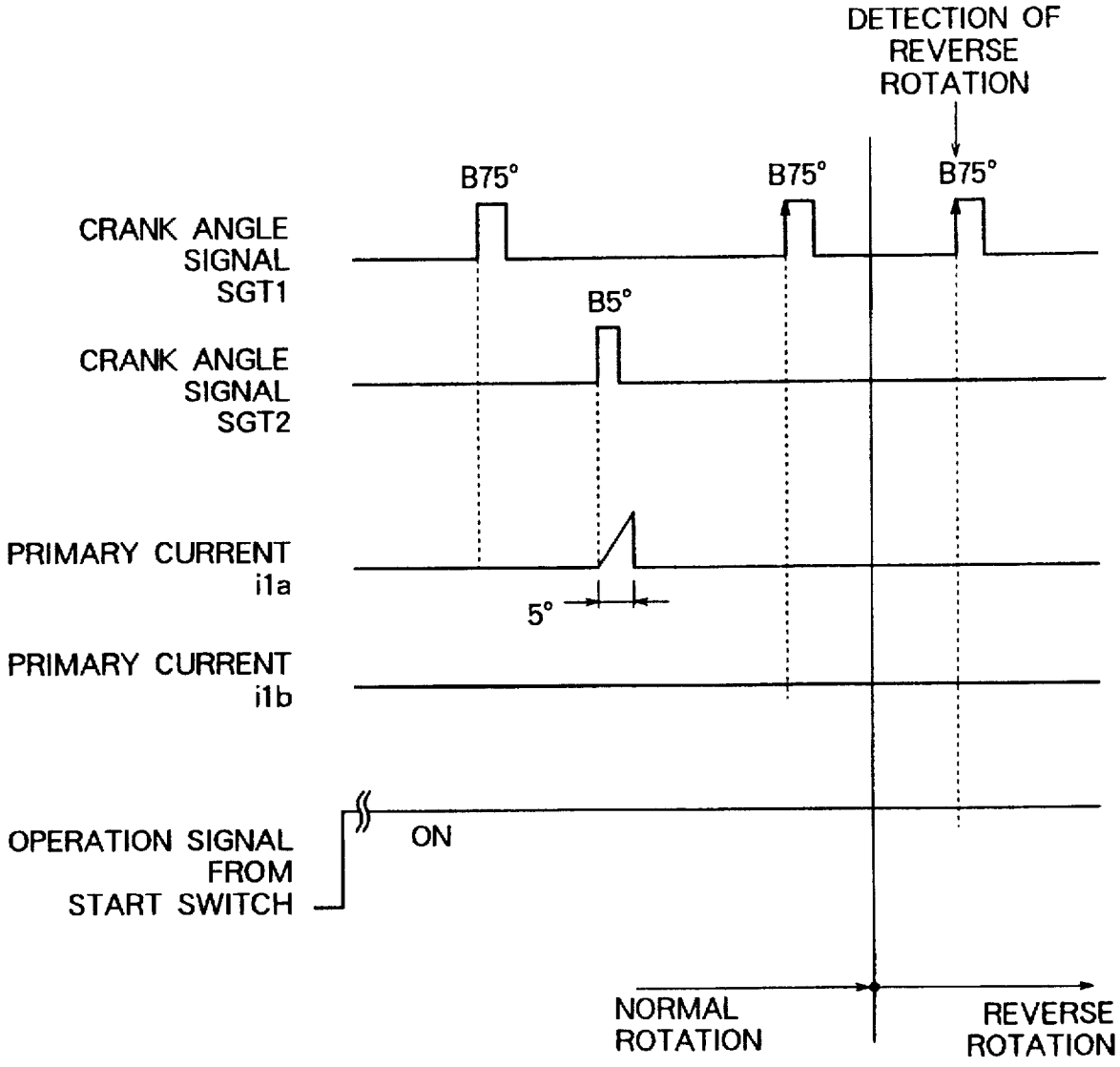
FIG. 9 is a timing chart explaining the primary current supply operation executed by the embodiment 3 of the present invention.

FIG. 8 and FIG. 9 are a flowchart and a timing chart showing primary current shut-off operation executed by the embodiment 3 of the present invention.

In this case, the timing calculation means refers to the reverse rotation flag F in reverse rotation discriminating means, does not start to supply the primary currents i1*a* and i1*b* at the first reference crank angle B75° as shown in FIG. 9 even in normal rotation while a start switch is turned on (at start), starts to supply the primary current i1 only at the second reference crank angle B5° and shuts off the supply of the primary current in the vicinity of a compression upper dead point after the rotation of a predetermined crank angle (for example, 5°).

In FIG. 8, the timing calculation means first determines whether an internal combustion engine operates at a low rotational speed or not (step S21) and if it is determined that the internal combustion engine operates in a steady operating state in which the engine does not operate at the low rotational speed (that is NO), the timing calculation means shuts off the primary current i1 by creating the drive signals P1 and P2 by timer control from an ordinary reference crank angle (step S22) and returns.

If it is determined at step S21 that the internal combustion engine operates at the low rotational speed (that is, YES), the timing calculation means determines whether reverse rotation occurs (whether a reverse rotation flag F is set to 1) or not (step S23) and if it is determined that F=0 (that is YES), since control is prohibited, the process returns as it is.

Further, if it is determined that F=1 (that is, YES), it is determined whether the crank angle signal SGT1 is input or not (step S24) and if it is determined that the crank angle signal SGT1 is input (that is, YES), it is subsequently determined whether the start switch is turned on (whether the internal combustion engine is being started) or not (step S25).

If the internal combustion engine is being started (that is, YES), the process returns as it is without starting to supply the primary current i1, whereas if it is determined that the internal combustion engine is not being started (that is, NO), since the internal combustion engine is operated at the low rotational speed at a time other than a starting time, the timing calculation means starts to supply the primary current i1 to thereby execute ordinary bypass control (step S26) and returns.

On the other hand, if it is determined at step S24 the first crank angle signal SGT1 is not input (that is, NO), the timing calculation means subsequently determines whether the second crank angle signal SGT2 is input or not (step S27) and if it is determined that the second crank angle signal SGT2 is not input (that is, NO), the process returns as it is.

Further, if it is determined that the second crank angle signal SGT2 is input (that is, YES) at step S27, the timing calculation means subsequently determines whether the internal combustion engine is being started or not (step S28). If it is determined that the internal combustion engine is not being started (that is NO), the timing calculation means shuts off the primary current i1 to thereby execute the ordinary bypass control (step S29) and the process returns.

With this operation, if the start switch is turned off when the internal combustion engine is in the low rotational operating state in which a rotation cycle is unstable as well as the reverse rotation switch F is cleared, the primary current i1 starts to be supplied at the first reference crank angle B75° and is shut off (for ignition) at the second reference crank angle B5°.

At the time, since the first reference crank angle B75° corresponds to the timing at which the initial current starts to be supplied and the second reference crank angle B5° corresponds to the timing at which initial ignition is executed in the vicinity of a compression upper dead point, the ignition timing in the low speed operation is properly controlled.

On the other hand, when it is determined that the internal combustion engine is being started (that is YES) at step S28, the timing calculation means starts to supply the primary current i1 at the second reference crank angle B5°, shuts off the primary current after the rotation of the crank angle 5° (in the vicinity of the compression upper dead point) (step S30) and the processing in FIG. 8 is returned.

With this operation, when the internal combustion engine operates at the low rotational speed in normal rotation, the primary currents i1 starts to be supplied to respective ignition coils only at the second reference crank angle B5° in response to the operation signal from the start switch.

Therefore, even if reverse rotation occurs after the first reference crank angle B75°, since the primary current i1 is not supplied, a timing at which the primary current i1 is shut off (timing of ignition) can be securely optimized without depending upon a timing at which reverse rotation occurs without the occurrence of unsatisfactory shut-off of the primary current i1.

Further, since the number of rotations at the low rotational speed is about several hundreds of rpm, even if the current is supplied during the period of time in which a crank shaft rotates the crank angle of about 5° from the second reference crank angle B5° to the compression upper dead point, a current supply time of several milliseconds can be sufficiently secured. Thus, excellent ignition control can be executed without causing any difficulty.

What is claimed is:

1. An ignition controller for an internal combustion engine, comprising:

an angle sensor for detecting the rotational angle of the internal combustion engine;

various sensors for detecting the operating state of the internal combustion engine;

ignition coils for imposing a high voltage to the ignition plugs of the respective cylinders of the internal combustion engine; and a control/arithmetic operation circuit for creating drive signals to at least said ignition coils based on the rotation angle and the operating state, wherein said angle sensor includes:

a plurality of sensor means for individually outputting a first pulse signal corresponding to the first reference crank angle of the respective cylinders and a second pulse signal corresponding to the second reference crank angle of the respective cylinders, and said control/arithmetic operation circuit includes:

timing calculation means for calculating the timings at which at least the ignition coils are controlled according to the operating state;

count means for counting the number of the pulses of one of the first and second pulse signals which are detected between two continuous pulses of the other of them;

reverse rotation discriminating means for discriminating the reverse rotation of the internal combustion engine based on at least one of the count values of the first and second pulse signals; and control prohibition means for prohibiting the output of the drive signals in response to a reverse rotation discriminating signal.

2. An ignition controller for an internal combustion engine according to claim 1, wherein said angle sensor creates:

a first crank angle signal as the first pulse signal; and a second crank angle signal as the second pulse signal, and said reverse rotation discriminating means creates:

the discrimination signal when the pulses of at least one of the first and second pulse signals are continuously counted.

3. An ignition controller for an internal combustion engine according to claim 1, wherein said angle sensor creates:

a crank angle signal as the first pulse signal; and a cylinder discrimination signal as the second pulse signal, wherein the second pulse signal includes respective one pulses showing the second reference crank angle and an even number of pulses created continuously to at least one of the respective one pulses to discriminate the respective cylinders and when the first pulse signals are continuously counted or when the counted value of the second pulse signal shows an even value, said reverse rotation discriminating means creates the discrimination signal.

4. An ignition controller for an internal combustion engine according to claim 1, wherein said various sensors include a start switch of the internal combustion engine and said reverse rotation discriminating means sets up a reverse rotation flag when the reverse rotation is discriminated as well as clears the reverse rotation flag in response to the operation signal from the start switch.

5. An ignition controller for an internal combustion engine according to claim 4, wherein:

the first reference crank angle corresponds to the timing at which an initial current starts to be supplied to the ignition coils of the respective cylinders; and the second reference crank angle corresponds to the timing at which initial ignition is executed to said ignition coils of the respective cylinders, and when the internal combustion engine is operated at a low rotational speed and the reverse flag is cleared, said control/arithmetic operation circuit starts to supply a current to the respective ignition coils at the second reference crank angle in response to the operation signal from the start switch and shuts off the current in the vicinity of a compression upper dead point after the rotation of a predetermined crank angle.

* * * * *

UNITED STATES PATENT AND TRADEMARK OFFICE

CERTIFICATE OF CORRECTION

PATENT NO. : 5,778,862

DATED : May 8, 1998

INVENTOR(S) : Wataru Fukui

It is certified that error appears in the above-identified patent and that said Letters Patent is hereby corrected as shown below:

Claim 1 should read as follows:

1. (Amended) An ignition controller for an internal combustion engine, comprising:

an angle sensor for detecting the rotational angle of the internal combustion engine;

[various] sensors for detecting the operating state of the internal combustion engine;

ignition coils for imposing a high voltage [to the] on ignition plugs of [the] respective cylinders of the internal combustion engine; and a control/arithmetic operation circuit for [creating] outputting drive signals to at least said ignition coils based on the [rotation] rotational angle and the operating state, wherein said angle sensor [includes] comprises:

a plurality of sensor means for individually outputting a first pulse signal corresponding to [the] a first reference crank angle of the respective cylinders and a second pulse signal corresponding to [the] a second reference crank angle of the respective cylinders, and wherein said control/arithmetic operation circuit [includes] comprises:

timing calculation means for calculating [the] timings at which at least the ignition coils are controlled according to the operating state;

UNITED STATES PATENT AND TRADEMARK OFFICE

CERTIFICATE OF CORRECTION

PATENT NO. : 5,778,862
DATED : May 8, 1998
INVENTOR(S) : Wataru Fukui

It is certified that error appears in the above-identified patent and that said Letters Patent is hereby corrected as shown below:

count means for counting the number of [the] pulses of one of the first and second pulse signals which are detected between two continuous pulses of the other of [them] said first and second pulse signals;

reverse rotation discriminating means for discriminating [the] a reverse rotation of the internal combustion engine based on [at least] a count value of said one [of the count values] of the first and second pulse signals; and control prohibition means for prohibiting [the] output of the drive signals in response to a reverse rotation discriminating signal.

Claim 2, line 7, after "and" insert --wherein--.

Claim 3, line 7, delete "one";

line 9, delete second occurrence of "one".

UNITED STATES PATENT AND TRADEMARK OFFICE

CERTIFICATE OF CORRECTION

PATENT NO. : 5,778,862

DATED : May 8, 1998

INVENTOR(S) : Wataru Fukui

It is certified that error appears in the above-identified patent and that said Letters Patent is hereby corrected as shown below:

Claim 4, line 2, delete "various";

line 3, delete "engine" and insert --engine,--;

line 4, after "and" insert --wherein-- and delete "up";

line 7, delete first occurrence of "the" and insert --an--.

Claim 5, line 3, delete second occurrence of "the";

line 4, delete "timing" and insert --a time--;

line 6, delete second occurrence of "the";

line 7, delete "timing" and insert --a time--.

Signed and Sealed this

Thirty-first Day of August, 1999

*Attest:*

*Attesting Officer*

Q. TODD DICKINSON

*Acting Commissioner of Patents and Trademarks*